US010352075B2

(12) United States Patent
Hirtsiefer et al.

(10) Patent No.: US 10,352,075 B2
(45) Date of Patent: Jul. 16, 2019

(54) FURNITURE HINGE

(71) Applicant: SAMET KALIP VE MADEN ESYA SAN. VE TIC. A.S., Kirac Esenyurt-Istanbul (TR)

(72) Inventors: Artur Hirtsiefer, Neunkirchen-Seelscheid (DE); Bernd Rödder, Ruppichteroth (DE)

(73) Assignee: Samet Kalip Ve Maden Esya San. Ve Tic. A.S., Istanbul (TR)

( * ) Notice: Subject to any disclaimer, the term of this patent is extended or adjusted under 35 U.S.C. 154(b) by 0 days.

(21) Appl. No.: 15/512,685

(22) PCT Filed: Sep. 4, 2015

(86) PCT No.: PCT/EP2015/070261
§ 371 (c)(1),
(2) Date: Mar. 20, 2017

(87) PCT Pub. No.: WO2016/045940
PCT Pub. Date: Mar. 31, 2016

(65) Prior Publication Data

US 2017/0284138 A1 Oct. 5, 2017

(30) Foreign Application Priority Data

Sep. 23, 2014 (DE) ..... 10 2014 113 714

(51) Int. Cl.
*E05D 5/08* (2006.01)
*E05D 3/12* (2006.01)

(52) U.S. Cl.
CPC ..... *E05D 5/08* (2013.01); *E05D 3/12* (2013.01); *E05Y 2600/52* (2013.01); *E05Y 2900/20* (2013.01); *Y10T 16/5543* (2015.01)

(58) Field of Classification Search
CPC ..... E05D 3/12; E05D 5/08; E05D 5/0276; E05D 7/123; E05D 7/125; E05Y 2600/52;
(Continued)

(56) References Cited

U.S. PATENT DOCUMENTS 5,463,796 A * 11/1995 Brustle ..... E05D 5/08 16/383
5,577,297 A * 11/1996 Lautenschlager ..... E05D 5/08 16/254

(Continued)

FOREIGN PATENT DOCUMENTS

DE 4315639 A1 * 12/1993 ..... E05D 5/08
EP 0738816 A1 10/1996
EP 2090731 A2 8/2009

OTHER PUBLICATIONS

International Search Report for PCT Application No. PCT/EP2015/070261 dated Nov. 18, 2015.

*Primary Examiner* — William L Miller
(74) *Attorney, Agent, or Firm* — Steven M. Shape; Dennemeyer & Associates, LLC

(57) ABSTRACT

The invention relates to a furniture hinge (10) having a stop (11), which is associated with a hinge cup element (50) having a hinge cup (52) and with at least one fastening element, in particular a clamping jaw (72.1, 72.2) of a spreading element (72) or a fastening pin (84.1, 84.2), for fastening the stop on a piece of furniture, having at least one actuating element (40, 80.1, 80.2), which is operatively connected to the fastening element, and having a hinge arm (20), which is connected to the hinge cup element in a foldable manner via an articulation connection. Here, it is provided that the at least one actuating element is arranged in the movement direction of the hinge arm so that it is moved from a first position to a second position by the hinge arm when the hinge arm is folded into the hinge cup. The furniture hinge can be mounted on a piece of furniture without additional tools.

12 Claims, 8 Drawing Sheets

(58) Field of Classification Search
CPC ..... E05Y 2900/20; Y10T 16/5543; Y10T 16/554; Y10T 16/5383; Y10T 16/53832; Y10T 16/535
USPC ..... 16/383, 382, 286, 287, 254
See application file for complete search history.

(56) References Cited

U.S. PATENT DOCUMENTS

| | | | | | |
|---|---|---|---|---|---|
| 5,613,796 | A * | 3/1997 | Salice | E05D 5/08 | 292/34 |
| 5,979,017 | A * | 11/1999 | Karl | E05D 5/08 | 16/382 |
| 6,081,970 | A * | 7/2000 | Wasilewski | E05D 5/08 | 16/383 |
| 6,279,200 | B1 * | 8/2001 | Ferrari | E05D 7/125 | 16/332 |
| 6,286,186 | B1 * | 9/2001 | Lautenschlager | A47B 95/00 | 16/258 |
| 8,006,348 | B2 * | 8/2011 | Ferrari | E05D 5/08 | 16/383 |
| 8,312,597 | B2 * | 11/2012 | Gallasch | E05D 5/08 | 16/383 |
| 2002/0100143 | A1 * | 8/2002 | Pyo | E05D 5/08 | 16/383 |
| 2009/0199362 | A1 * | 8/2009 | Ferrari | E05D 5/08 | 16/242 |

* cited by examiner

FURNITURE HINGE

RELATED APPLICATIONS

This is a 35 U.S.C. 371 National Stage Patent Application of International Application No. PCT/EP2015/070261, filed Sep. 4, 2015, which claims priority to German application 10 2014 113 714.0, filed Sep. 23, 2014, each of which is hereby incorporated by reference in its entirety.

BACKGROUND OF THE INVENTION

The invention relates to a furniture hinge having a stop, which is associated with a hinge cup element having a hinge cup and with at least one fastening element, in particular a clamping jaw of a spreading element or a fastening pin, for fastening the stop on a piece of furniture, having at least one actuating element, which is operatively connected to the fastening element, and having a hinge arm, which is connected to the hinge cup element in a foldable manner via an articulation connection.

Such a furniture hinge is known from the publication EP 1 643 061 A1. The furniture hinge is fastened with a hinge cup in a bore of a piece of furniture. Laterally to the hinge cup, a flange is arranged. On the flange, laterally to the hinge cup, two bolts are rotatably mounted. The bolts unilaterally support projecting anchoring ribs arranged at a slant and protruding to the side of the hinge cup into the bore of the piece of furniture. The rotation axis of the bolt lies in the direction of the longitudinal axis of the bore. Outside of the bore, each bolt is connected to an actuating lever arranged above the flange. In a first mounting position of the actuating lever, the anchoring ribs of the bolts face inward toward the hinge cup. For fastening the furniture hinge in the bore, the actuating levers are pivoted into a second position. As a result, the bolts are rotated so that the anchoring ribs cut into the bore wall. Due to the slanted arrangement of the anchoring ribs, the hinge cup is pulled into the bore in the process. The hinge cup can thus be attached to a piece of furniture without tools. The poor manageability of the actuating lever, which has a relatively flat design, is disadvantageous. In this context, a flat design of the actuating lever is desirable, so that said actuating lever does not project too far on the furniture surface.

The publication EP 0 552 607 B1 discloses a hinge cup, which can be fastened in a mounting bore of a portion of the piece of furniture. The hinge cup comprises an anchoring part and a cup part attached rotatably thereto. The fastening of the hinge cup occurs via clamping jaws. For the mounting of the hinge cup, the anchoring part is introduced into the mounting bore, and the cup part, on which a hinge arm is fastened, is rotated about a rotation axis extending along the central axis of the mounting bore, from a first position into a second position. As a result, spreading parts press the clamping jaws onto the bore, as a result of which the anchoring part is firmly anchored to the cup part in the furniture door. The hinge cup can thus be mounted without the need of tool. In order to prevent accidental detachment of the hinge/cup, a stop is provided, wherein a spring mounted push button is mounted in a positioning pin, which engages in a locking position into a corresponding opening. The elaborate structure of the clamping device is disadvantageous. Another disadvantage results from the fact that, during the mounting, the hinge cup is not pulled in the direction of the mounting bore and is thus not definitively fastened in the position thereof. The required elaborate stop represents an additional disadvantage.

From EP 1 205 673 B1, a hinge top as part of a furniture hinge is known, which can be mounted in a corresponding bore in a furniture door. On a flange-shaped part arranged laterally to the hinge cup, expansion dowels are arranged, which are embedded in corresponding bores in the furniture door and anchored there by expansion. For this purpose, in the expansion dowel, a pin broadening in the shape of a wedge towards the end is arranged in the expansion dowel and brings about the expansion of the expansion dowel by rotation about the central longitudinal axis thereof. For this purpose, the pin supports a pinion at the free end thereof, into which a toothed rod engages. The toothed rod is connected to a cover plate mounted so it is linearly movable on the flange-shaped part. By shifting the cover plate, the pin is rotated due to the engagement of the toothed rod in the scratcher, and the expansion dowel expands. The disadvantage here is the small engagement surface due to the low installation height of the cover plate, surface over which the required force has to be applied for the manual shifting of the cover plate and the rotation of the two pins.

It is the object of the invention to provide a furniture hinge, which enables the mounting of the furniture hinge on a piece of furniture without tools while at the same time enabling a simple handling.

The object of the invention is attained in that at least one actuating element is arranged in the movement direction of the hinge arm so that, when the hinge arm is folded into the hinge cup, it is moved by the hinge arm from a first position to a second position. In the first position of the actuating element, the furniture hinge can thus be introduced into corresponding bores of a piece of furniture and, in a second position of the actuating element, can be fastened on the piece of furniture. The hinge arm fulfills the additional function of an actuating tool. In this manner, a fastening of the furniture hinge on the piece of furniture without tools is possible.

SUMMARY OF THE INVENTION

According to a preferred embodiment of the invention, it is possible to provide that the hinge arm in connection with an outer articulation connection comprises an outer hinge lever, that, when the hinge arm is folded in, the hinge lever is folded into the hinge cup so that an actuating surface of the hinge lever, which faces the hinge cup, is positioned against a cup bottom of the hinge cup, and that the actuating element is arranged in the movement direction of the hinge lever so that it is moved by the actuating surface of the hinge lever from the first position into the second position when the hinge arm is folded in. The hinge lever performs a pivoting movement about the rotation axis thereof directed into the hinge cup. Here, the movement of the hinge lever is oriented so that actuating elements arranged both inside and outside the hinge cup can be adjusted.

According to a particularly preferred embodiment variant of the invention, it is possible to provide that the actuating element is designed in the form of a bracket, which is mounted pivotably and on both sides in facing cup side walls of the hinge cup, that a rotation axis of the actuating element is oriented transverse to the movement direction of the hinge arm and/or of hinge lever, and that the bracket is oriented in the first position toward the opening of the hinge cup and in the second position toward the cup bottom of the hinge cup. The actuating element is thus arranged entirely in the hinge cup, and, outside of the hinge cup, no additional actuating elements are needed. Nevertheless, by actuating the actuating element with the hinge lever, a simple handling without tools is achieved. The pivoting movement of the actuating element is adapted to the movement of the hinge lever during folding into the hinge cup, so that the actuating element can be rotated smoothly and without jamming from the first position thereof into the second position. The bracket is oriented in the second position along the cup bottom, so that the inner space of the hinge cup remains free for receiving the front section of the hinge arm. Since, outside of the hinge cup, no actuating elements are needed, accidental detachment of the furniture hinge can be prevented reliably, which results in a savings on additional components for stopping the actuating elements. Moreover, the surface of the furniture hinge lying on the piece of furniture outside of the bore is designed uniformly and continuously without interfering gap relative to an actuating element.

A secure holding of the furniture hinge on a piece of furniture can be achieved in that the bracket is connected along the rotation axis thereof to at least one cam mounted in the cup side wall, that, when the actuating element is moved from the first position into the second position, the cam brings about a lifting movement of a clamping jaw in contact with the hinge cup from outside, and that the clamping jaw comprises at least one integrally formed spreading extension, which, in the transition from the first position into the second position, cooperates with the hinge cup so that the clamping jaw is spread away from the hinge cup. The hinge cup of the furniture hinge is pulled by the superposed lifting and spreading movement of the clamping jaw into the bore on the piece of furniture and fastened there. Due to an appropriate design of the cam with a large gear ratio, a sufficient lifting and spreading movement can be achieved, even in the case of a relatively low possible adjustment path of the actuating element, in order to securely fasten the furniture hinge on the piece of furniture.

According to another embodiment variant of the invention, it is possible to provide that the at least one an actuating element is designed as an actuating lever pivotably mounted in a flange cover of the hinge cup element, that a rotation axis of the actuating lever is oriented in the direction of the surface normal of the flange cover, and that the actuating lever in the first position with the end thereof facing away from the rotation axis is arranged in the movement area of the hinge arm and/or of the outer hinge lever of the hinge arm. The actuating lever is thus introduced from the side needed into the movement area of the hinge arm. If the hinge arm is folded in toward the hinge cup, it presses the actuating lever from the first position into the second position, whereby the furniture hinge is fastened via corresponding fastening elements. In this embodiment, the at least one actuating element is arranged outside of the hinge cup. This facilitates access during the disassembly of the furniture hinge, wherein the actuating lever has to be moved back by hand or with a tool from the second position into the first position.

If it is provided that the actuating lever transmits a rotation to the fastening element so that the fastening element is spread or rotated, then known fastening elements such as, for example, expansion dowels or asymmetrically constructed cylindrical fastening pins with unilaterally attached clamping ribs can be manipulated by the actuating lever.

The achievable adjustment path of the fastening elements is limited by the usable movement area of the hinge arm. In order to achieve nonetheless a sufficient adjustment of the fastening element in order to fasten the furniture hinge securely on the piece of furniture, it is possible to provide that, between the actuating element and the fastening element, a gear mechanism is arranged. The gear ratio of the gear mechanism is here advantageously selected so that, in the adjustment of the fastening element from the first position into the second position, the fastening element performs the predetermined movement for the fastening on the piece of furniture.

In order to prevent accidental detachment of the furniture hinge, it is possible to provide that the actuating element is stopped in the second position. The fastening element thus remains in the second position, even if the hinge arm is folded back again. The stopping can thus be implemented directly on the actuating element, but also on the gear mechanism, the cam or on the fastening element.

BRIEF DESCRIPTION OF THE DRAWINGS

The invention is explained in further detail below in reference to an exemplary embodiment represented in the drawings. The figures show.

DETAILED DESCRIPTION OF THE INVENTION

Figure 1:
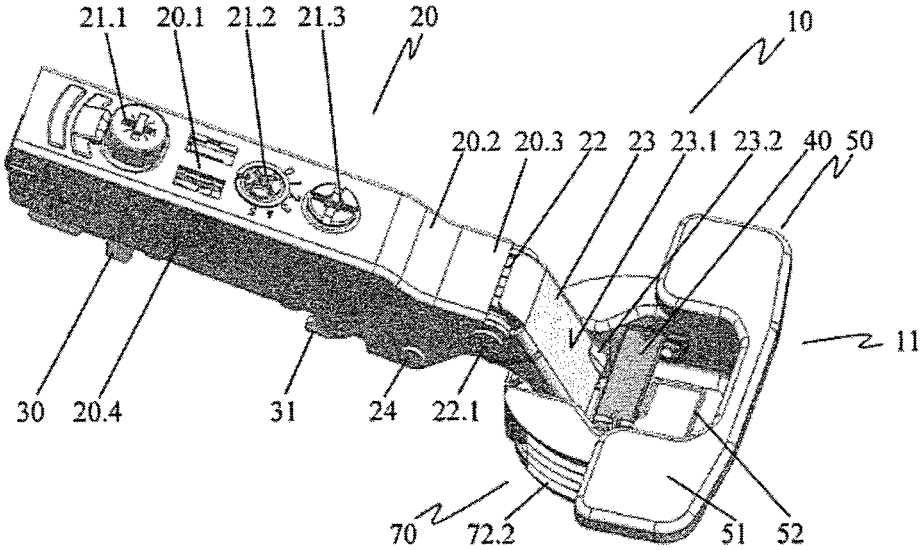
FIG. 1 in a perspective front view, a furniture hinge in a first position of an actuating element of a lifting arrangement, FIG. 2 in an exploded view, a stop of the furniture hinge, FIG. 3 in a perspective representation, the hinge cup element from FIG. 2, FIG. 4 in a perspective representation, a spreading element from FIG. 2, FIG. 5 in a perspective representation, the spreading element from FIG. 4 with an arrangement of the clamping jaws as present after an injection molding process, FIG. 6 the actuating element for a lifting arrangement from FIG. 2, FIG. 7 in a perspective representation, the cam of the lifting arrangement from FIG. 2, FIG. 8 in a perspective cross-sectional representation, the stop of the furniture hinge in a first position of a lifting arrangement, FIG. 9 in a perspective representation, a detail of the furniture hinge in an intermediate position of the actuating element and of the lifting arrangement with a transparent view into the hinge cup, FIG. 10 in a perspective view, the furniture hinge from FIG. 1, in a second position of the actuating element and of the lifting arrangement, FIG. 11 in a perspective cross-sectional representation, the stop of the furniture hinge shown in FIG. 8, in the second position of the actuating element and of the lifting arrangement, FIG. 12 in a perspective view, the stop of a furniture hinge with two laterally arranged actuating elements, in a first position, FIG. 13 the stop shown in FIG. 12, in a perspective rear view, FIG. 14 the stop shown in FIGS. 12 and 13, in a top view with two laterally arranged actuating elements, in a second position, and FIG. 15 the stop shown in FIG. 14, in a rear view.

FIG. 1 shows, in a perspective front view, a furniture hinge 10 in a first position of an actuating element 40 of a lifting arrangement.

A hinge arm 20 and a stop 11 are associated with the furniture hinge 10. The hinge arm 20 is connected via an articulation to a stop 11. Along a backspan 20.1 of the hinge arm 20, a depth adjusting screw 21.1, a setting element 21.2, and a support adjusting screw 21.3 are arranged. Side legs 20.4 are connected to the backspan 20.1 on both sides. The hinge arm 20 engages in a connecting element 30 which comprises connecting hooks 31. Toward the articulation, the backspan 20.1 transitions via a transition section 20.2 into a section 20.3 recessed relative to the backspan 20.1. The recessed section 20.3 is connected via an outer articulation connection 22 to an outer hinge lever 23, which comprises, oriented toward a hinge cup 52 with an actuating element 40, an actuating surface 23.1 with a protrusion 23.2. The outer articulation connection 22 is formed with an outer articulation pin 22.1 as a shaft which is led into the side legs 20.4. Correspondingly, an inner articulation pin 24 of an inner articulation pin, not shown, is held in the side legs 20.4.

The stop 11 is associated with a hinge cup element 50 having the hinge cup 52 and a flange cover 51, as well as a with a spreading element 70, of which a second clamping jaw 72.2 can be seen in the selected representation.

Figure 12:
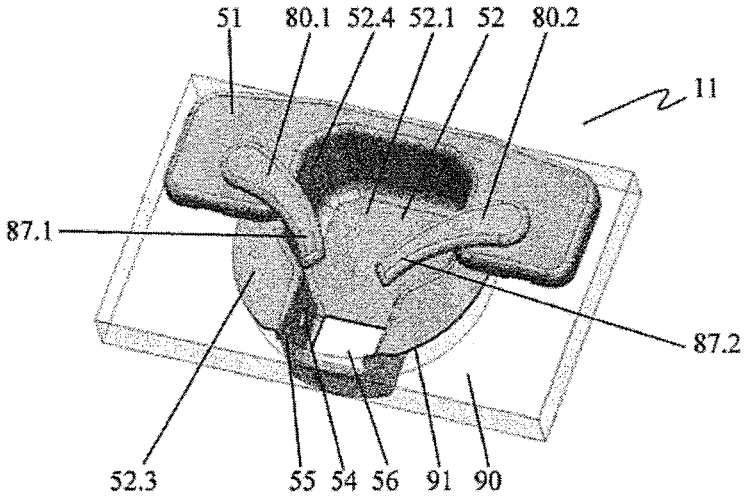

In the mounted state, the stop 11 is associated with a furniture door and the hinge arm 20 are associated with a body of a piece of furniture 90 shown in FIG. 12. Here, the connecting element 30 with the connecting hook 31 engages in a connecting part, not shown, fastened on the body. Via the depth adjusting screw 21.1, the setting element 21.2 and the support adjusting screw 21.3, the furniture door can be oriented relative to the body.

The actuating element 40 is part of a lifting arrangement. By rotating the actuating element 40, a lifting and spreading movement of the second clamping jaw 72.2 and of a first clamping jaw 72.1 shown in FIG. 2 is brought about, by means of which the stop 11 is fastened on the furniture door.

Figure 2:
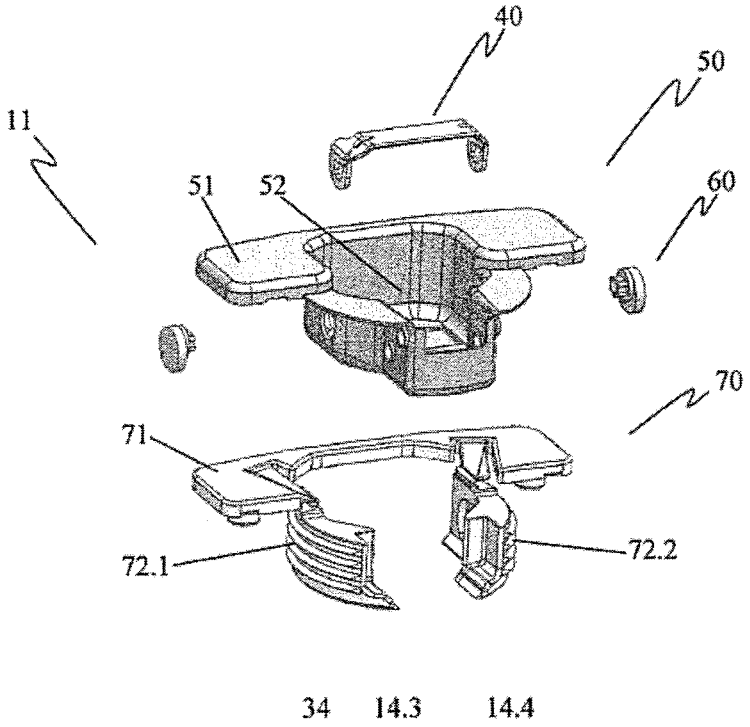

FIG. 2 shows the stop 11 of the furniture hinge 10 in an exploded view. The stop 11 is associated with the actuating element 40, the hinge cup element 50, two cams 60 as well as the spreading element 70. The hinge cup element 50 is formed substantially by a flange cover 51 and the hinge cup 52. In the spreading element 70, the first clamping jaw 71.1 and the second clamping jaw 71.2 are movably connected to a flange 71. Here, the clamping jaws 71.1, 71.2 are shaped so that they at least partially radially encompass the hinge cup 52 in the assembled state of the furniture hinge 10. The actuating element 40 is designed so that it is arranged entirely in the hinge cup 52 in the assembled state.

Figure 3:
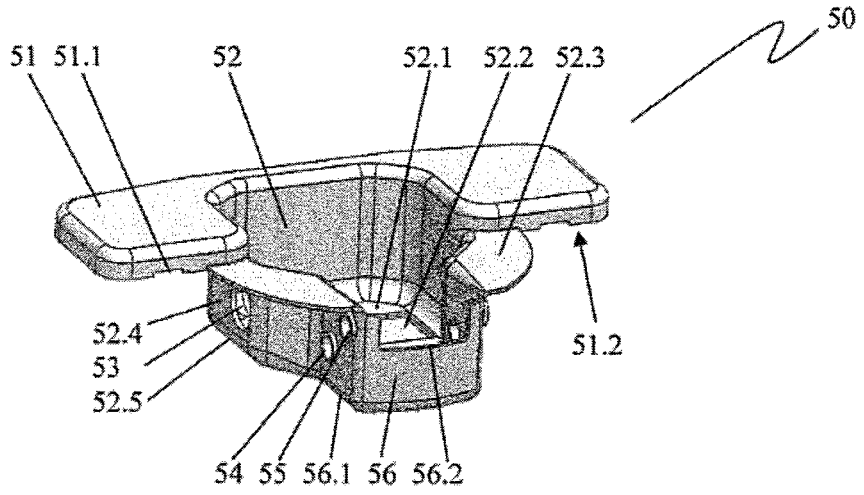

In a perspective representation, FIG. 3 shows the hinge cup element 50 from FIG. 2 with the hinge cup 52 and the flange cover 51 connected to the hinge cup 52 so as to form a single piece. The hinge cup element 50 is made of metal.

The flange cover 51 is designed substantially flat with two support areas arranged laterally to the hinge cup 52, and in each case a tool recess 51.1 is formed on them. The flange cover 51 encompasses approximately half the periphery of the hinge cup 52. It is open downward and thereby forms a flange recess 51.2 toward the piece of furniture 90. The hinge cup 51 is formed by cup side walls 52.4 and a cup bottom 52.1 with a transition implemented in the shape of a cup rounding 52.5. In the cup bottom 52.1, a rectangular recess 52.2 is provided. Adjoining the flange cover 51, the cup side walls 52.4 of the hinge cup 52 are closed off by contact surfaces 52.3, which are oriented in the plane of the flange cover 51. On the opposite side from the flange cover 51, an articulation receiving housing 56 is arranged as part of the hinge cup 52, the side walls of which also transition through a housing rounding 56.1 into the cup bottom 52.1. The articulation receiving housing 56 has a housing recess 56.2 toward the cup opening. On the cup side walls 52.4 of the articulation receiving housing 56, an outer articulation pin bearing 54 and an inner articulation pin bearing 55 in the form of perforations arranged so they face one another are provided. Two additional facing perforations form cam bearings 53.

The hinge cup element 50 is designed to form a mobile connection to the hinge arm 20 via the articulation pin bearing 54, 55. Here, the hinge cup 52 forms a recess for one end of the hinge arm 20 with furniture door closed. When the furniture door is open, the hinge arm 20 is led through the housing recess 56.2 of the articulation receiving housing 56 into the hinge cup 52.

Figure 4:
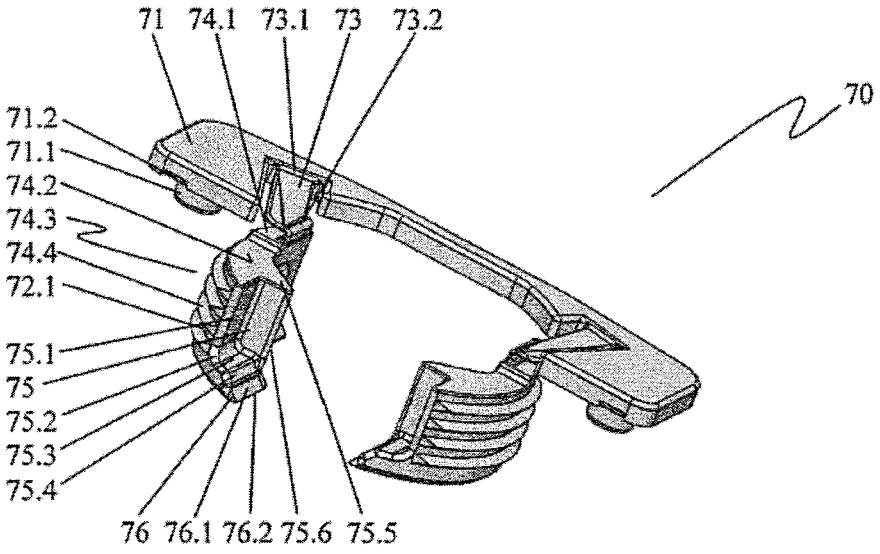

In a perspective representation, FIG. 4 shows the spreading element 70 from FIG. 2, with the substantially flat designed flange 71 and the two clamping jaws 72.1, 72.2. The spreading element 70 is made of plastic. On the flange 71, on each side, a centering pin 71.1 and an insertion notch 71.2 for a tool are provided in each case. The clamping jaws 72.1, 72.2, starting from the upper sides thereof, are connected via film hinges 73 to the flange 71. The film hinges 73 here respectively comprise a first film articulation 73.1 oriented toward the flange 71 and a second film articulation 73.2 oriented toward the respective clamping jaw 72.1, 72.2.

The clamping jaws 72.1, 72.2 are constructed mirror symmetrically in the embodiment example, so that, for the simplified representation, the identifier in each case is marked on only one of the clamping jaws 72.1, 72.2. The film hinges 73 are formed on front-face fastening surfaces 74.1 of the clamping jaws 72.1, 72.2, surfaces which are oriented toward the flange 71. The fastening surfaces 74.1 transition into recessed support surfaces 74.2. Directed radially outward, the clamping jaws 72.1, 72.2 comprise cylindrically shaped outer surfaces 74.3, along which anchoring ribs 74.4 are arranged. On the opposite side from the flange 71, the clamping jaws 72.1, 72.2 in each case comprise an articulation pin recess 75 in the form of a recess. The articulation pin recesses 75 are in each case formed by a side surface 75.1, which transitions via a rounding section 75.2 into a recess bottom 75.3, and a ridge 75.5 with a ridge edge 75.6. The recess bottom 75.3 ends in a bevel 75.4, which ends with the ridge edge 75.6 of the ridge 75.5.

The clamping jaws 72.1, 72.2 are arranged facing so that the articulation pin recesses 75 with the ridges 76 face one another at a distance. On the undersides of the clamping jaws 72.1, 72.2, under the articulation pin recesses 75, front spreading extensions 76 are arranged. The front spreading extensions 76 have a substantially triangular shape and thus form a front spreading surface 76.1, which transitions into the bevel 75.6 of the articulation pin recess 75, and a front spreading extension edge 76.2. The front spreading surfaces 76.1 of the two clamping jaws 72.1, 72.2 face one another at a distance. Here, they project relative to the ridge edges 75.6 of the ridges 75.5.

The spreading element 70 is shaped so that the flange 71 thereof can be introduced into the flange recess 51.2 of the flange cover 51 of the hinge cup element 50 shown in FIG. 3 and covered thereby. When mounted, the two clamping jaws 72.1, 72.2 enclose the hinge cup 52 over a portion of the cup side walls 52.4. The two film hinges 73 enable a simple and smooth pivoting of the clamping jaws 72.1, 72.2 away from the hinge cup 52.

Figure 5:
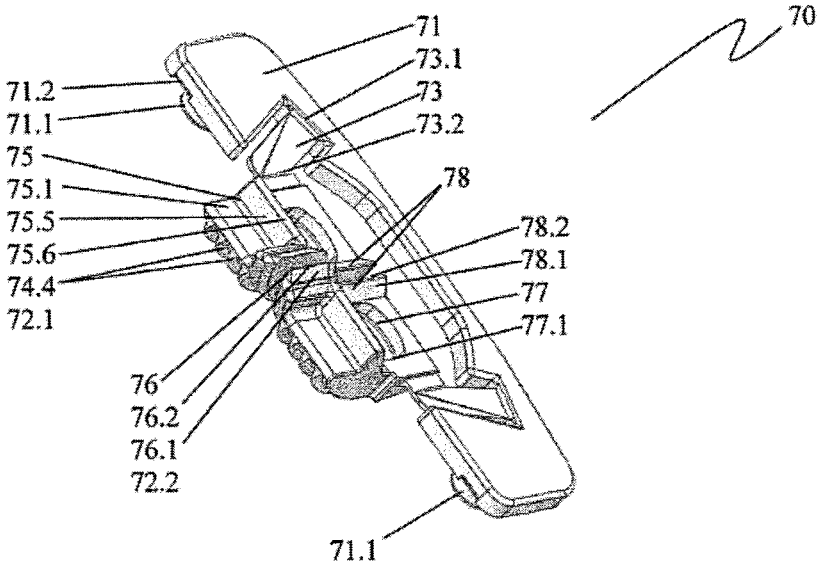

In a perspective representation, FIG. 5 shows the spreading element 70 from FIG. 4 with an arrangement of the clamping jaws 72.1, 72.2 as present after an injection molding process. Accordingly, identical components are labeled identically.

Compared to the representation in FIG. 4, the clamping jaws 72.1, 72.2 are pivoted on the second film articulations 73.2 of the film hinges 73 so that they face one another with their undersides. In addition to the components already described in FIG. 4, in FIG. 5, two rear spreading extensions 78 can be seen, which are each arranged on the side of the clamping jaws 72.1, 72.2 facing away from the film hinge 73. The spreading extensions 78 have a substantially triangular contour, as a result of which rear spreading surfaces 78.1 extending at a slant are formed. In the orientation of the clamping jaws 72.1, 72.2 shown in FIG. 4, the rear spreading extensions 78 with formed rear spreading extension edges 78.2 face in the direction of the hinge cup 52. Here, the rear spreading surfaces 78.1 are in the same plane as the front spreading surfaces 76.1.

Between the film hinges 73 and the rear spreading extensions 78, cam recesses 77 are formed in the clamping jaws 72.1, 72.2. The cam recesses 77 comprise flattened pressing surfaces 77.1 on the side of the film hinge 73.

In the orientation of the clamping jaws 72.1, 72.2 shown in FIG. 5, the spreading element 70 has no undercuts in the direction of the surface normal of the flange 71. The spreading element 70 can thus be produced correspondingly inexpensively in a plastic injection molding process with a relatively simple injection mold without slider.

Figure 6:
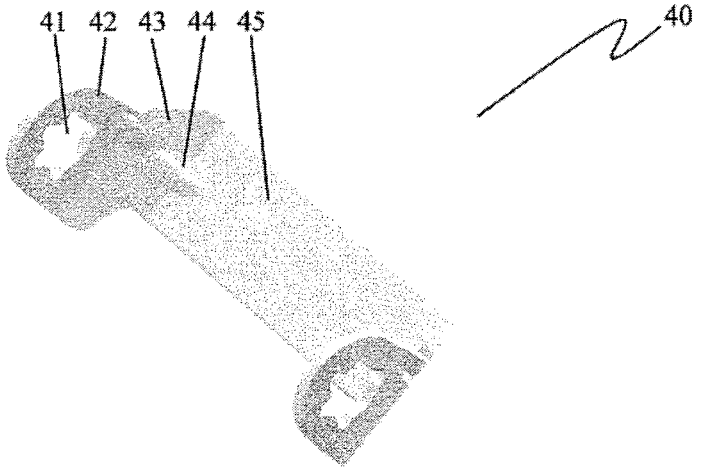

FIG. 6 shows the actuating element 40 of the lifting arrangement from FIG. 2. The actuating element 40 is formed by a bracket 45 and two side parts 42 arranged angled thereto. The transition from the bracket 45 to the side parts 42 occurs via two transition sections 73 arranged at a slant. The edges between the bracket 45 and the transition section 73 as well as between the transition section 73 and the side parts 42 are reinforced by embossings 44. In the side parts 42, positive-locking elements 41 in the form of star-shaped perforations are arranged, which face one another along a rotation axis which is not shown. In order to establish a definitive peripheral position of the positive-locking elements 41, in each case one tooth of the star-shaped perforations is not formed.

Figure 7:
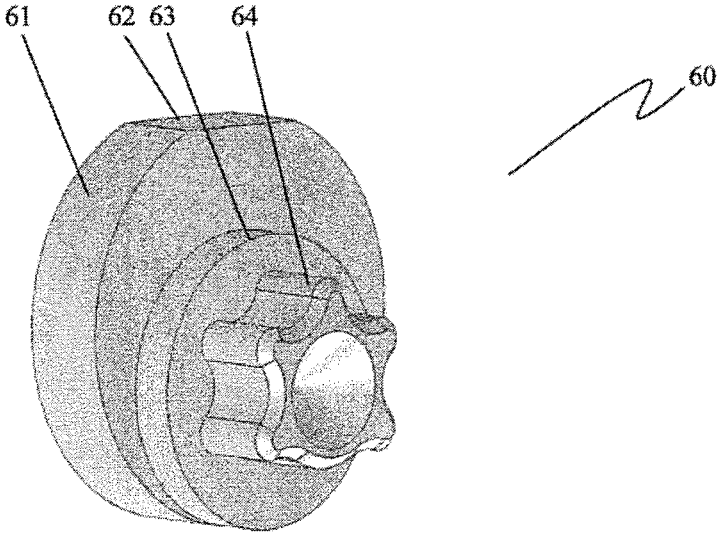

In a perspective representation, FIG. 7 shows the cam 60 of the lifting arrangement from FIG. 2. The cam 60 is formed as a single piece by a positive-locking counter-element 64, a connected shaft 63 and a cam disk 61. The shaft 63 is designed in the shape of a cylinder, wherein the central axis of the shaft 63 forms a rotation axis of the cam 60. The outer diameter of the shaft 63 is designed so that the cam 60 can be rotatably mounted with the shaft 63 in the cam bearing 53 shown in FIG. 3 in the cup side wall 52.4 of the hinge cup 52. Here, the cam 60 is oriented so that the positive-locking counter-element 64 protrudes into the hinge cup 52 and the cam disk 61 protrudes into the cam recess 77 of the spreading element 70 shown in FIG. 5.

The cam disk 61 is oriented eccentrically relative to the rotation axis of the cam 60. It has a flattened portion 62 on its peripheral section farthest from the rotation axis.

The positive-locking counter-element 64 is adapted in terms of the peripheral contour thereof to the star shape of the positive-locking elements 41 of the actuating element 40, which are shown in FIG. 6, wherein, again, one tooth of the star-shaped contour is omitted.

Figure 8:
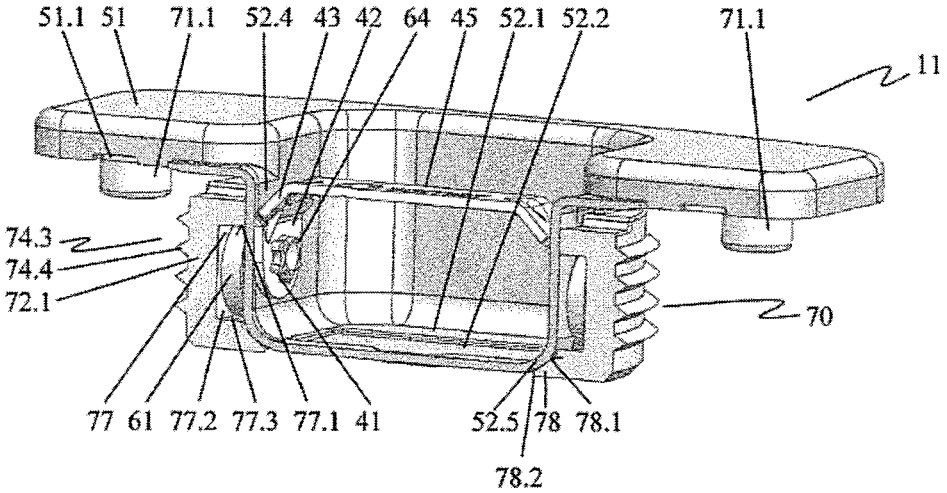

FIG. 8 shows, in a perspective cross-sectional representation, the stop 11 of the furniture hinge 10 in a first position of the actuating element 40 and thus of the lifting arrangement in the assembled state. The clamping jaws 72.1, 72.2 of the spreading element 70 are arranged in contact with the hinge cup 52. The cams 60 are mounted with the shafts 63 thereof in the cam bearings 53 of the hinge cup element 50 shown in FIG. 3. The actuating element 40 engages with the positive-locking elements 41 thereof in the positive-locking counter-elements 64 of the cam 60 and thus form positive-locking connections with the cams 60. The actuating element 40 is arranged entirely within the hinge cup 52.

The cam disks 61 are introduced into the cam recesses 77 of the clamping jaws 72.1, 72.2. The cam recesses 77 are implemented here in the form of recesses in the clamping jaws 72.1, 72.2, each with a pressing surface 77.1 oriented in the direction of the flange 71, with a side wall 77.2 and with a bottom surface 77.3 facing the pressing surface 77.1. The cam disks 61, on the peripheries thereof, contact the pressing surfaces 77.1 of the cam recesses 77.

The flange 71 of the spreading element 70 is introduced into the flange recess 51.2 of the flange cover 51 and covered thereby. The centering pins 71.1 point in the direction facing away from the flange cover 51.

The cams 60, together with the cam bearings 53 of the hinge cup elements 50 and with the actuating element 40, form the lifting arrangement. In the depicted first position of the actuating element 40 and of the lifting arrangement, the bracket 45 of the actuating element 40 is oriented toward the opening of the hinge cup 52. As a result of the respective missing tooth in the star-shaped contours of the positive-locking elements 41 of the actuating element 40 and of the positive-locking counter-elements 64 of the cam 60, there is a clear orientation of the cam 60 with respect to the actuating element 40. In the first position of the actuating element and of the lifting arrangement, the cams 60 are rotated so that the cam disks 61, with the flattened areas thereof farthest from the rotation axis, point in the direction of the bottom surfaces 77.3 of the cam recesses 77. In this position, the clamping jaws 72.1, 72.2 with the rear spreading surfaces 78.1 of the rear spreading extensions 78 thereof are in contact with the cup rounding 52 in the transition from the cup side walls 52.4 to the cup bottom 52.1. Accordingly, not shown, the front spreading surfaces 76.1 of the front spreading extensions 76, which are shown in FIG. 4, are in contact with the housing rounding 56.1 in the transition from the cup side walls 52.4 in the area of the articulation receiving housing 56 to the cup bottom 52.1 in this area.

In the assembly of the stop 11 in the production of the furniture hinge 10, first the actuating element 40 is introduced into the hinge cup 52 and the cams 60 are inserted through the cam bearing 53 into the positive-locking elements 41 of the actuating element 40. The actuating element 40 is brought into the first position. Subsequently, the spreading element 70 is shifted over the hinge cup 52, so that the cams 60 are received in the cam recesses 77, and the flange 71 is received in the flange recess 51.2 of the flange cover 51. When the spreading element 70 is shifted onto the hinge cup 52, the clamping jaws 72.1, 72.2 are pivoted from their fabrication position shown in FIG. 5 into the mounting position shown in FIGS. 4 and 8.

Figure 14:
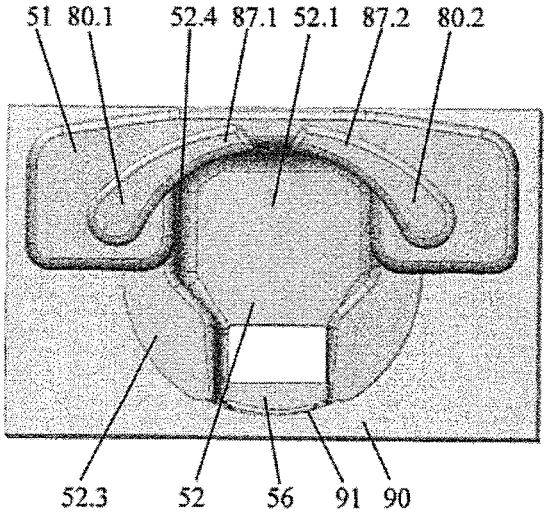
Figure 15:
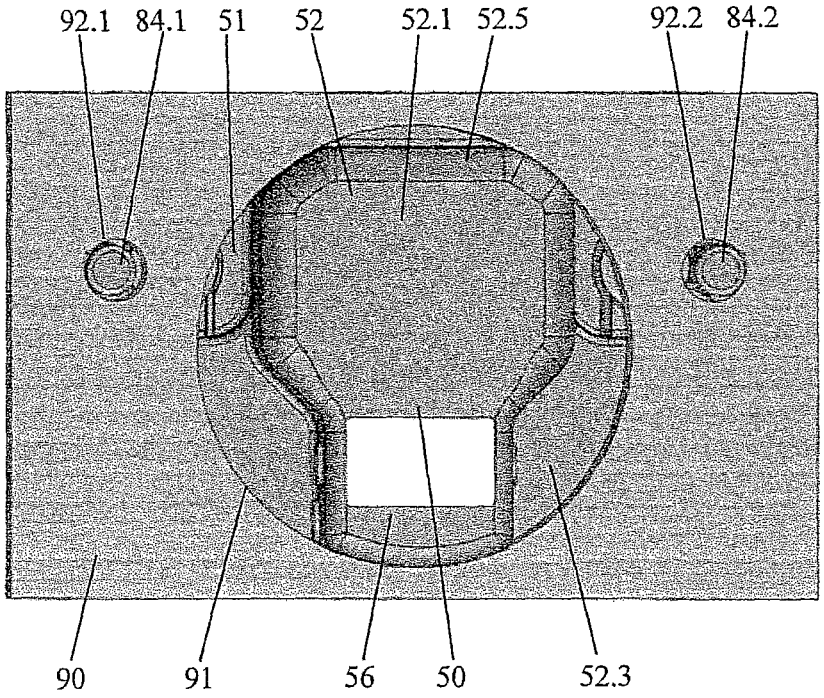

In the first position of the actuating element 40 and of the lifting arrangement, the clamping jaws 72.1, 72.2 are not spread, so that the hinge cup 52 with the clamping jaws 72.1, 72.2 can be introduced into a corresponding bore 91 in a furniture door, shown in FIGS. 12, 14 and 15. The correct radial orientation of the furniture hinge 10 is here ensured by the centering pins 71.1, which engage in centering bores 92.1, 92.2, shown in FIG. 15, which are correspondingly provided on the furniture door.

Figure 9:
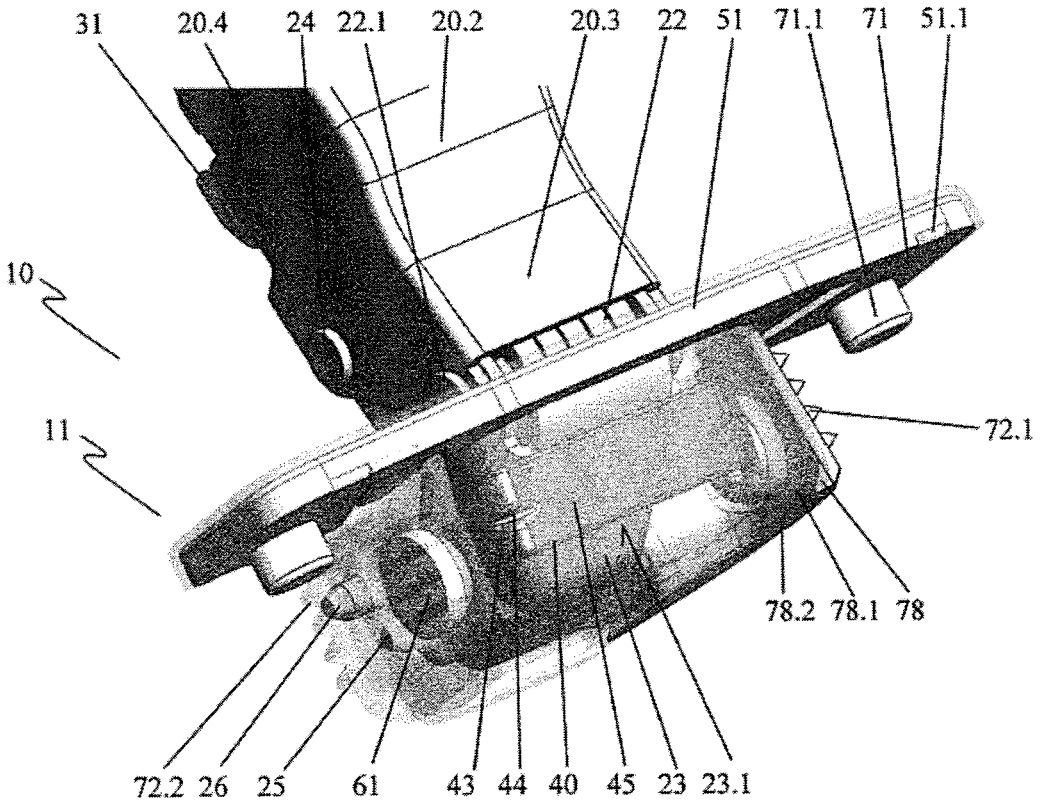

FIG. 9 shows a perspective representation of a detail of the furniture hinge 10 in an intermediate position of the actuating elements 80.1, 80.2 and of the lifting arrangement with a transparent view into the hinge cup 52.

In addition to the components that have already been described, an outer articulation pin 25 and an inner articulation pin 26 are shown in FIG. 9. The outer articulation pin 25 is mounted in the outer articulation pin bearings 54 shown in FIG. 3 on the articulation receiving housing 56 of the hinge cup 52. Correspondingly, the inner articulation pin 26 is arranged in the inner articulation pin bearings 55. With the outer articulation pin 25, the outer hinge lever 23 is movably mounted, and with the inner articulation pin 26, an inner hinge lever arranged under a hidden inner hinge lever is movably mounted.

FIG. 9 shows the furniture hinge 10 in an intermediate position during the folding in of the hinge arm 20 during the mounting of the furniture hinge 10 on a piece of furniture 90. The sequence of movements of the hinge arm 20 here corresponds to the movement thereof during the closing of a furniture door mounted with the furniture hinge 10 on a cabinet body.

Due to the folding in of the hinge arm 20 about the rotation axes formed by the inner articulation pin 26 and the outer articulation pin 25, the outer hinge lever 23 bends at the outer articulation connection 22 and turns into the hinge cup 52. Here, the outer hinge lever 23 performs a rotation about the outer articulation pin 25. In the process, the actuating surface 23.1 of the hinge lever 23, oriented in the rotation direction, butts against the edge of the bracket 45 of the actuating element 40, which faces the hinge lever 23, and rotates said actuating element about the rotation axis thereof formed by the bearing of the cams 60. The actuating element 40 is thus moved by the hinge arm 20 from the first position thereof in the direction of the second position thereof. Due to the rotation of the actuating element 40 and of the cams 60 connected thereto, the clamping jaws 72.1, 72.2 are moved by the cam disks 61 in a lifting movement in the direction of the flange 71. In the process, they are pressed by the spreading extensions 76, 78 in contact with the cup rounding 52.5 or respectively the housing rounding 56.1 away from the hinge cup 52 and spread. The furniture hinge 10 can thus be fastened in the bore 10 of a piece of furniture 90 by folding in of the hinge arm 10 without using additional tools.

Figure 10:
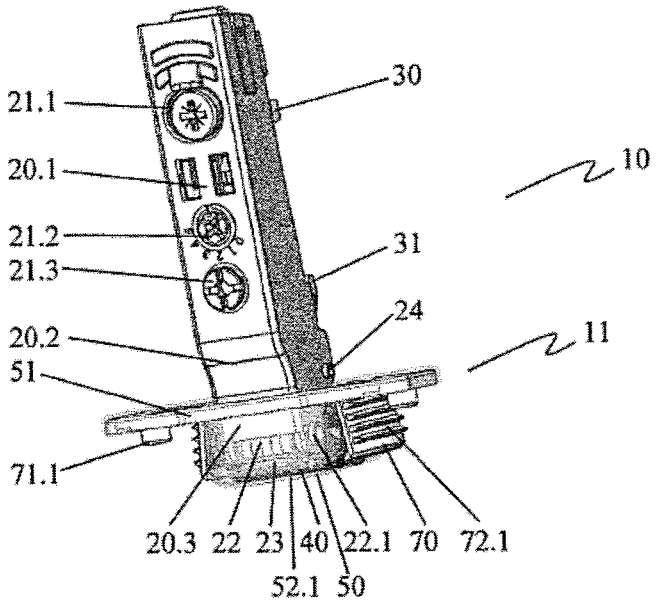

FIG. 10 shows, in a perspective view, the furniture hinge 10 from FIG. 1 in a second position of the actuating element 40 and of the lifting arrangement.

The hinge arm 10 is completely folded in, so that the outer hinge lever 23 with the actuating surface 23.1 thereof lies opposite the cup bottom 52.1 of the hinge cup 52. The recessed section 20.3 of the hinge arm 20 is arranged opposite the cup side wall 52.4 in the area of the flange cover 51. Due to the movement of the hinge lever 23 from the first position shown in FIG. 1 via the intermediate position shown in FIG. 9 into the second position shown in FIG. 10, the actuating element 40 is rotated from the first position shown in FIG. 1 via the intermediate position shown in FIG. 9 into the second position shown in FIG. 10. In this second position, the bracket 45 of the actuating element 40 is in contact with the cup bottom 52.1 and engages in the recess 52.2. Due to the now-completed rotation of the actuating element 40 and of the associated cam 60, the clamping jaws 72.1, 72.2 are lifted completely in the direction of the flange 51 and thus spread maximally. Thereby, in the second position of the actuating element 40, the stop 11 is firmly anchored in the bore 91 of the piece of furniture 90.

Figure 11:
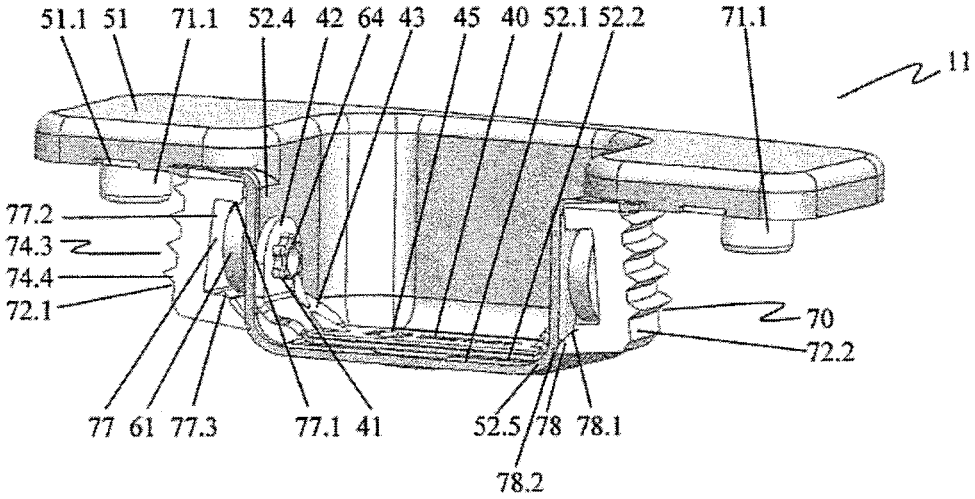

FIG. 11 shows, in a perspective cross-sectional representation, the stop 11 of the furniture hinge 10 shown in FIG. 8 in the second position of the actuating element 40 and of the lifting arrangement.

In comparison to the first position of the lifting arrangement shown in FIG. 8, the actuating element 40 is adjusted in accordance with the sequence of movements described in FIGS. 9 and 10, so that the bracket 45 faces the cup bottom 52.1 of the hinge cup 52. The bracket 45 is here arranged partially in the recess 52.2 of the cup bottom 52.1. In this position of the actuating element 40, the flattened portions 62 of the cam disks 61 of the cams 60 connected with positive lock to the actuating element 40 point in the direction of the pressing surfaces 77.1 of the cam recesses 77. The areas of the flattened portions 62 of the cam disks 61 are the farthest from the rotation axes of the cams 60. Due to the rotation of the actuating element 40 and thus of the cams 60 from the first position shown in FIG. 8 into the second position shown in FIG. 11, the clamping jaws 72.1, 72.2 are therefore moved in a lifting movement in the direction toward the flange 71 and the flange cover 51. Due to the rear spreading surfaces 78.1 of the rear spreading extensions 78, which are arranged at a slant with respect to the lifting movement, and due to the front spreading surfaces 76.1 of the front spreading extensions 76, which are shown in FIG. 4, the clamping jaws 72.1, 72.2 pressed by the cup roundings 52.5 or respectively the house roundings 56.1 of the hinge cup 52, so that, due to the lifting movement, an additional spreading movement of the clamping jaws 72.1, 72.2 is forced. The superposed lifting and spreading movement of the clamping jaws 72.1, 72.2 is enabled by the film hinge 73 and the arrangement of the film articulations 73.1, 73.2.

Due to the spreading movement, the clamping jaws 72.1, 72.2 are pressed against the wall of the bore 91 in which the furniture hinge 10 is to be mounted. As a result, the stop 11 is fastened in the bore 11. In the process, the anchoring ribs 74.4 lead to a connection between the clamping jaws 72.1, 72.2 and the bore wall, which is able to withstand stress.

Due to the lifting movement which is superposed on the spreading, the hinge cup element 50 is pulled in the direction of the bore 91 of the piece of furniture 90, so that the flange cover 51 and the contact surfaces 52.3 on the margin of the bore 91 are pressed firmly on the surface of the piece of furniture 90. Together with the centering pins 71.1 inserted into the corresponding centering bores 92.1, 92.2, an accurate positioning of the stop 11 and thus of the furniture hinge 10 is thus achieved.

The design of the lifting arrangement with cams 60 has the advantage that, by an appropriate selection of the cam disks 61, a relatively large lifting movement of the clamping jaws 72.1, 72.2 can be achieved. In this way, the clamping jaws 72.1, 72.2 can be lifted to the point that the spreading extension edges 76.2, 78.2 of the front and rear spreading extensions 76, 78 are in contact with the cup side walls 52.4, as a result of which a maximum spreading of the clamping jaws 72.1, 72.2 is achieved. Moreover, in the second position of the lifting arrangement, the spreading extensions 76, 78 are no longer in contact, by the spreading surfaces 76.1, 78.1 thereof, which are oriented at a slant, with the cup roundings 52.5 or respectively housing roundings 56.1, so that, due to the radially inward directed forces acting from outside on the clamping jaws 72.1, 72.2, no resetting forces, which pull the clamping jaws 72.1, 72.2 again back into the first position thereof, are generated. Another advantage of a large lifting movement in comparison to a smaller one results from the fact that the spreading surfaces 76.1, 76.2, with identical achievable spreading of the clamping jaws 72.1, 72.2, can have a greater inclination. As a result, the pressures acting between the hinge cup 52 and the spreading extensions 76, 78 can be kept small. Conversely, with identical inclination of the spreading surfaces 76.1, 76.2, a greater spreading movement is possible.

The second position of the actuating element 40 and of the lifting arrangement is stopped by the flattened portions 62 of the cam disks 61, which are in contact with the pressing surfaces 77.1 of the clamping jaws 72.1, 72.2. Due to the flattened portions 62, an unintended rotation of the cams 60 is prevented. An additional stopping of the actuating element and of the lifting arrangement in the second position is achieved by the recess 52.2 in the cup bottom 52.1, in which the bracket 45 of the actuating element engages at least partially. When the hinge arm 20 is folded back, the actuating element 40 and the lifting arrangement thus remain in the second position, as a result of which the stop 11 remains permanently anchored in the bore 91 of the piece of furniture 90.

Since the actuating element 40 is arranged entirely in the hinge cup 52, an unintended opening of the clamping device can be ruled out. Moreover, due to the flange cover 51, a uniform surface of the hinge cup element 50 without interfering operating elements can be produced.

In order to remove the furniture hinge 10, the actuating element 40 and thus the lifting arrangement, optionally with the aid of an appropriate tool, are rotated back into the first position thereof, so that the bracket 45 is again oriented in the direction of the opening of the hinge cup 52. The clamping jaws 72.1, 72.2 are pressed back in the process by the pressure of the cam disks 61 onto the bottom surfaces 77.3 of the cam recesses 77 into the first position thereof, shown in FIG. 8, and the clamping is released.

FIG. 12 shows, in a perspective view, the stop 11 of a furniture hinge 10 with laterally arranged actuating elements 80.1, 80.2 in a first position of the actuating elements 80.1, 80.2. The cup element 52 of the furniture hinge 10 is inserted into the bore 91 of a piece of furniture 90.

The actuating elements 80.1, 80.2 are mounted rotatably on the flange cover 51 of the hinge cup element 50. The rotation axes are here arranged laterally to the hinge cup 52 and oriented in the direction of the surface normal of the flange cover 51. In the first position of the actuating elements 80.1, 80.2 shown, slightly curved actuating levers 87.1, 87.2 of the actuating elements 80.1, 80.2 are oriented in the direction of the opening of the hinge cup 52 and thus with the front ends thereof in the direction of the articulation receiving housing 56 of the hinge cup 52. The actuating levers 87.1, 87.2 are thereby arranged in a movement direction within a movement area of the hinge arm 20 when the hinge arm 20 is folded in. The movement of the hinge arm 20, in the sequence thereof corresponds to the sequence of movements shown in FIGS. 1, 9 and 10. When the hinge arm 20 is folded in, it butts, by the actuating surface 23.1 thereof, against the ends of the actuating levers 87.1, 87.2 and rotates them into a second position shown in FIG. 14, as a result of which the stop 11 is fastened in the bore 91 of the piece of furniture 90.

Figure 13:
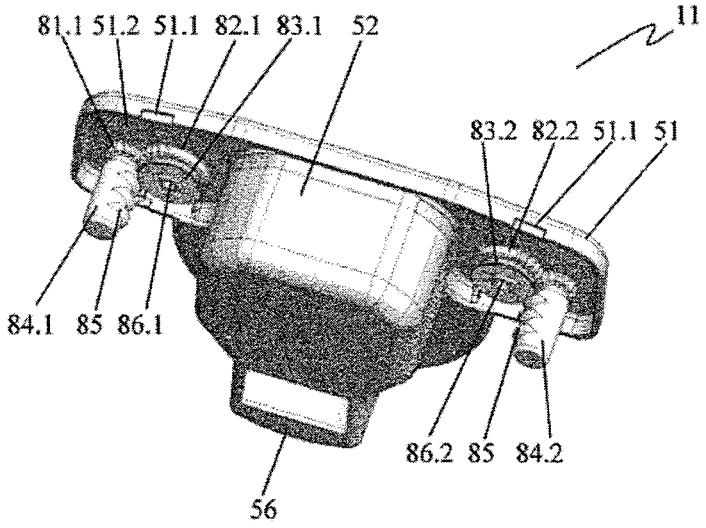

FIG. 13 shows the stop 11 shown in FIG. 12 in a perspective rear view.

The flange cover 51 is connected to the hinge cup 52 so as to form a single piece and it forms, on the back side, the flange recess 51.2. Shafts connected to the actuating elements 80.1, 80.2 shown in FIG. 12 and arranged hidden are mounted rotatably in the flange cover 51 and led into the flange recess 51.2. On the end side, the shafts are implemented as square pins 86.1, 86.2. On the square pins 86.1, 86.2, starting from the flange cover 51, in each case first a drive gearwheel 82.1, 82.2, and connected thereto, a disk-shaped holding element 83.1 83.2 are attached with positive lock. Smaller drive gearwheels 82.1, 82.2, which engage in the drive gearwheels 82.1, 82.2, are in each case mounted rotatably in the flange cover 51, laterally to the drive gearwheels 81.1, 81.2 from the periphery. On the drive gearwheels 81.1, 81.2, fastening pins 84.1, 84.2 are fastened. The fastening pins 84.1, 84.2 are implemented in cylindrical shape and are oriented so they lead with the central longitudinal axes thereof away from the flange cover 51. Unilaterally on the cylinder surface, the fastening pins 84.1, 84.2 have projecting clamping ribs 85.

The drive gearwheels 82.1, 82.2, the holding elements 83.1, 83.2 as well as the drive gearwheels 81.1, 81.2 are thus formed flat and arranged so that they are entirely accommodated in the flange recess 51.2 of the flange cover 51.

In the represented first position of the actuating elements 80.1, 80.2, the fastening pins 84.1, 84.2 are oriented so that the clamping ribs 85 are oriented toward the hinge cup 52. By swiveling the actuating elements 80.1, 80.2 from the first position into the second position shown in FIG. 14, the fastening pins 84.1, 84.2, due to the engagement of the drive gearwheels 82.1, 82.2 in the drive gearwheels 81.1, 81.2, are rotated outward and thus facing away from the hinge cup 52. By means of the drive gear wheels 82.1, 82.2 and the drive gear wheels 81.1, 81.2, a gear mechanism is formed. The gear ratio of the gear mechanism is selected so that, when the actuating elements 80.1, 80.2 are moved from the first position into the second position, the fastening pins 84.1, 84.2 are rotated by at least approximately 180°.

FIG. 14 shows the stop 11 shown in FIGS. 12 and 13 in a top view with two laterally arranged actuating elements 80.1, 80.2 in the second position of the actuating elements 80.1, 80.2. According to the invention, the actuating elements 80.1, 80.2 are moved by the hinge arm 20, not shown, which is mounted in the articulation receiving housing 56 in a foldable manner, when the hinge arm 20 is folded in, from the first position shown in FIG. 12 into the second position, as described in reference to FIG. 12. In this second position of the actuating elements 80.1, 80.2, the fastening pins 84.1, 84.2 shown in FIG. 13 are arranged with the clamping ribs 85 thereof directed outward.

FIG. 15 shows the stop shown in FIG. 14 in a rear view. The hinge cup 52 is embedded in the bore 91 of the piece of furniture 90. The hinge cup element 50, by means of the flange cover 51 and the contact surfaces 52.3, is in contact with the piece of furniture 90 laterally to the bore 91. The fastening pins 84.1, 84.2 are embedded in the centering bores 92.1, 92.2 formed laterally to the bore 91. Here, the fastening pins 84.1, 84.2 are arranged with respect to the centering bores 92.1, 92.2 so that the rotation axes of the fastening pins 84.1, 84.2 are farther from the hinge cup 52 than the central longitudinal axes of the centering bores 92.1, 92.2. The fastening pins 84.1, 84.2 are thus arranged offset outward in the centering bores 92.1, 92.2. In the first position of the actuating elements 80.1, 80.2, the fastening pins 84.1, 84.2 are oriented so that the clamping ribs 85 thereof are arranged in the free spaces formed between the fastening pins 84.1, 84.2 and the respective bore walls of the centering bores 92.1, 92.2 in the direction toward the hinge cup 52. By actuation of the actuating elements 80.1, 80.2, the fastening pins 84.1, 84.2 are rotated by at least approximately 180°, so that the clamping ribs 85 are turned into the bore walls and as a result establish a connection of the furniture hinge 10 to the piece of furniture 90. The clamping ribs 85 are preferably oriented at a slant on the periphery of the fastening pins 84.1, 84.2. As a result, when the clamping ribs 85 engage in the bore walls, a pulling movement is generated, which pulls the hinge cup element 50 in the direction of the piece of furniture 90 and positions it accurately.

The actuating elements 80.1, 80.2, the gear mechanism or the fastening pins 84.1, 84.2 are preferably stopped in the second position thereof.

For the removal of the furniture hinge 10, the actuating elements 80.1, 80.2 are moved by hand or by means of a tool from the second position back into the first position. The fastening pins 84.1, 84.2 are rotated thereby so that the clamping ribs 85 no longer engage in the walls of the centering bores 92.1, 92.2, so that the furniture hinge 10 can be removed.

The actuating of the actuating elements 40, 80.1, 80.2 from the first position into the second position occurs, according to the invention, by the folding in of the hinge arm. If this not possible, for example, due to unfavorable installation situations, the actuating elements 40, 80.1, 80.2 can also be actuated by hand, and the furniture hinge 10 can thereby be fastened on the piece of furniture 90.

The invention claimed is:

1. A furniture hinge (10) having a stop (11), which is associated with a hinge cup element (50) having a hinge cup (52) with side walls (52.4), a bottom (52.1,) and with at least one fastening element defining a clamping jaw (72.1, 72.2) of a spreading element (70) or a fastening pin (84.1, 84.2), for fastening the stop (11) on a piece of furniture, having at least one actuating element (40, 80.1, 80.2), which is operatively connected to the fastening element, and having a hinge arm (20) and a hinge lever (23), which is connected to the hinge cup element (50) in a foldable manner via an articulation connection (22), wherein the at least one actuating element (40, 80.1, 80.2) is arranged in a movement direction of the hinge arm (20) so as to be moved from a first position to a second position by the hinge arm (20), and wherein the at least one actuating element (40, 80.1, 80.2) comprises a bracket (45), which is mounted pivotably and on both sides in facing the cup side walls (52.4) of the hinge cup (52), wherein a rotation axis of the actuating element (40, 80.1, 80.2) is oriented transverse to the movement direction of the hinge arm (20) and/or of the hinge lever (23), wherein the bracket (45) is oriented in the first position toward the opening of the hinge cup (52) and in the second position toward the cup bottom (52.1) of the hinge cup (52), and wherein the bracket (45) is connected along the rotation axis thereof to at least one cam (60) mounted in the cup side wall (52.4), that, when the at least one actuating element (40, 80.1, 80.2) is moved from the first position into the second position, the cam (60) brings about a lifting movement of the clamping jaw (72.1, 72.2) in contact with the hinge cup (52) from outside, and wherein the clamping jaw (72.1, 72.2) comprises at least one integral spreading extension (76, 78), which, in the transition from the first position into the second position, cooperates with the hinge cup (52) so that the clamping jaw (72.1, 72.2) is spread away from the hinge cup (52).

2. The furniture hinge (10) according to claim 1 wherein the hinge arm (20) with the articulation connection (22) comprises the hinge lever (23), that, when the hinge arm (20) is folded, the hinge lever (23) is folded into the hinge cup (52) so that an actuating surface (23.1) of the hinge lever (23), which faces the hinge cup (52), is positioned against the cup bottom (52.1) of the hinge cup (52), and wherein the at least one actuating element (40, 80.1, 80.2) is arranged in the movement direction of the hinge lever (23) so that it is moved by the actuating surface (23.1) of the hinge lever (23) from the first position into the second position when the hinge arm (20) is folded.

3. The furniture hinge (10) according to claim 1 wherein the at least one actuating element (40, 80.1, 80.2) defines an actuating lever (87.1, 87.2) pivotably mounted in a flange cover (51) of the hinge cup element (50), that a rotation axis of the actuating lever (87.1, 87.2) is oriented in the direction of the surface normal of the flange cover (51), and wherein the actuating lever (87.1, 87.2) in the first position with the end thereof facing away from the rotation axis is arranged in the movement area of the hinge arm (20) and/or of the hinge lever (23) of the hinge arm (20).

4. The furniture hinge (10) according to claim 3 wherein the actuating lever (87.1, 87.2) transmits a rotation to the fastening element so that the fastening element is spread or rotated.

5. The furniture hinge (10) according to claim 1 wherein the actuating element (40, 80.1, 80.2) is stopped in the second position.

6. A furniture hinge (10) having a stop (11), which is associated with a hinge cup element (50) having a hinge cup (52) and with at least one fastening element defining a clamping jaw (72.1, 72.2) of a spreading element (70) or a fastening pin (84.1, 84.2), for fastening the stop (11) on a piece of furniture, having at least one actuating element (40, 80.1, 80.2), which is operatively connected to the at least one fastening element, and having a hinge arm (20) and a hinge lever (23), which is connected to the hinge cup element (50) in a foldable manner via an articulation connection (22), wherein the at least one actuating element (40, 80.1, 80.2) is arranged in the movement direction of the hinge arm (20) so as to be moved from a first position to a second position by the hinge arm (20) when the hinge lever (23) is folded into the hinge cup (52), wherein between the at least one actuating element (40, 80.1, 80.2) and the at least one fastening element, a gear mechanism is arranged.

7. The furniture hinge (10) according to claim 6 wherein the hinge arm (20) the articulation connection (22) comprises the hinge lever (23), that, when the hinge arm (20) is folded, the hinge lever (23) is folded into the hinge cup (52) having a cup bottom (52.1) so that an actuating surface (23.1) of the hinge lever (23), which faces the hinge cup (52), is positioned against the cup bottom (52.1) of the hinge cup (52), and wherein the at least one actuating element (40, 80.1, 80.2) is arranged in the movement direction of the hinge lever (23) so that it is moved by the actuating surface (23.1) of the hinge lever (23) from the first position into the second position when the hinge arm (20) is folded.

8. The furniture hinge (10) according to claim 6 wherein the at least one actuating element (40, 80.1, 80.2) defines a bracket (45), which is mounted pivotably and on both sides in facing cup side walls (52.4) of the hinge cup (52), that a rotation axis of the at least one actuating element (40, 80.1, 80.2) is oriented transverse to the movement direction of the hinge arm (20) and/or of the hinge lever (23), and that the bracket (45) is oriented in the first position toward the opening the hinge cup (52) and in the second position toward the cup bottom (52.1) of the hinge cup (52).

9. The furniture hinge (10) according to claim 8 wherein the bracket (45) is connected along the rotation axis thereof to at least one cam (60) mounted in the cup side wall (52.4), that, when the at least one actuating element (40, 80.1, 80.2) is moved from the first position into the second position, the cam (60) brings about a lifting movement of the clamping jaw (72.1, 72.2) in contact with the hinge cup (52) from outside, and that the clamping jaw (72.1, 72.2) comprises at least one integrally formed spreading extension (76, 78), which, in the transition from the first position into the second position, cooperates with the hinge cup (52) so that the clamping jaw (72.1, 72.2) is spread away from the hinge cup (52).

10. The furniture hinge (10) according to claim 6 wherein the at least one actuating element (40, 80.1, 80.2) defines an actuating lever (87.1, 87.2) pivotably mounted in a flange cover (51) of the hinge cup element (50), that a rotation axis of the actuating lever (87.1, 87.2) is oriented in the direction of the surface normal of the flange cover (51), and that the actuating lever (87.1, 87.2) in the first position with the end thereof facing away from the rotation axis is arranged in the movement area of the hinge arm (20) and/or of the hinge lever (23) of the hinge arm (20).

11. The furniture hinge (10) according to claim 10 wherein the actuating lever (87.1, 87.2) transmits a rotation to the fastening element so that the fastening element is spread or rotated.

12. The furniture hinge (10) according to 9 wherein the actuating element (40, 80.1, 80.2) is stopped in the second position.

* * * * *